US008733622B2

(12) United States Patent
Learn

(10) Patent No.: US 8,733,622 B2
(45) Date of Patent: May 27, 2014

(54) BLANK AND CONTAINER HAVING AN ANTI-BUCKLING MECHANISM

(75) Inventor: Angela Elizabeth Learn, Gilbertsville, PA (US)

(73) Assignee: Dopaco, Inc., Exton, PA (US)

( * ) Notice: Subject to any disclaimer, the term of this patent is extended or adjusted under 35 U.S.C. 154(b) by 277 days.

(21) Appl. No.: 13/269,374

(22) Filed: Oct. 7, 2011

(65) Prior Publication Data

US 2013/0087607 A1 Apr. 11, 2013

(51) Int. Cl.
*B65D 5/20* (2006.01)
*B65D 5/66* (2006.01)

(52) U.S. Cl.
USPC ..... 229/114; 229/146; 229/906; 229/920; 229/931

(58) Field of Classification Search
USPC ..... 229/906, 920, 930–931, 114, 146, 229/160.1, 902; 220/4.23
See application file for complete search history.

(56) References Cited

U.S. PATENT DOCUMENTS

| | | | | |
|---|---|---|---|---|
| 1,839,752 | A | 1/1932 | Fogg | |
| 3,228,710 | A * | 1/1966 | Wieslaw | 281/38 |
| 4,232,816 | A * | 11/1980 | Johnson et al. | 229/114 |
| 4,266,713 | A | 5/1981 | Maroszek | |
| 4,360,147 | A | 11/1982 | Brauner | |
| 4,559,259 | A | 12/1985 | Cetrelli | |
| 4,792,085 | A | 12/1988 | Waring, III et al. | |
| 4,844,330 | A | 7/1989 | Roosa et al. | |
| 4,930,681 | A | 6/1990 | Fultz et al. | |
| 5,044,549 | A | 9/1991 | Beales | |
| RE33,979 | E * | 6/1992 | Cortopassi | 206/459.1 |
| 5,205,476 | A | 4/1993 | Sorenson | |
| 5,221,040 | A | 6/1993 | Sorenson | |
| 5,332,147 | A | 7/1994 | Sorenson | |
| 5,388,758 | A * | 2/1995 | Scovell | 229/146 |
| 5,553,772 | A | 9/1996 | Jensen | |
| 5,702,054 | A * | 12/1997 | Philips et al. | 229/110 |
| 5,707,004 | A | 1/1998 | Cai | |
| 5,788,145 | A | 8/1998 | Grahahm et al. | |
| 5,826,781 | A | 10/1998 | Jensen | |
| 5,875,960 | A | 3/1999 | Nanno | |
| 5,909,840 | A | 6/1999 | Schultheiss | |
| 6,041,997 | A | 3/2000 | Jensen | |
| 6,283,364 | B1 | 9/2001 | Gray, Sr. | |
| 6,349,875 | B1 | 2/2002 | Whitnell | |
| 6,386,441 | B2 * | 5/2002 | Philips | 229/143 |
| 6,481,259 | B1 * | 11/2002 | Durney | 72/324 |
| 6,695,202 | B2 | 2/2004 | Miess | |
| 6,863,212 | B2 | 3/2005 | Stone et al. | |
| 7,232,054 | B2 | 6/2007 | Yocum | |
| 7,980,454 | B2 * | 7/2011 | Burton et al. | 229/120.18 |
| 8,006,893 | B2 * | 8/2011 | Burke et al. | 229/146 |
| 2007/0108262 | A1 * | 5/2007 | D'Amato | 229/146 |

* cited by examiner

*Primary Examiner* — Gary Elkins
*Assistant Examiner* — Scott McNurlen
(74) *Attorney, Agent, or Firm* — Armstrong Teasdale LLP

(57) ABSTRACT

A blank of sheet material for forming a container is provided. The blank includes a tray panel assembly, a cover panel assembly, a fold line connecting the tray panel assembly and the cover panel assembly, and an anti-buckling mechanism interrupting the fold line. The anti-buckling mechanism includes a series of cuts positioned at least partially below the fold line in the tray panel assembly. The series of cuts extends more than half a length of the fold line. Each cut of the series of cuts is substantially straight. The anti-buckling mechanism further includes an upper cut line defined in the cover panel assembly.

20 Claims, 17 Drawing Sheets

BLANK AND CONTAINER HAVING AN ANTI-BUCKLING MECHANISM

BACKGROUND OF THE INVENTION

The embodiments described herein relate generally to an anti-buckling mechanism for a container and, more particularly, to an anti-buckling mechanism for use with a clamshell-type container.

At least some known containers are clamshell-type containers having a lower tray and an upper cover connected at a fold line. At least some known trays and covers include walls that taper outward from a fold line toward a free edge. Such tapering may cause the container to buckle at the fold line when the container is opened and closed. As such, at least some known containers include anti-buckling features in the tray, the cover, and/or along the fold line.

One known anti-buckling feature in U.S. Pat. No. 5,332,147 includes a first cut along a hinge line joining the tray and the cover, and a second cut in a back panel positioned to one side of the first cut, wherein the second cut is a continuous curve having a first end point located in the back panel and a second end point intersecting the first cut. A known anti-buckling feature in U.S. Pat. No. 5,221,040 includes a first cut along a hinge line joining the tray and the cover, and a second cut in a back panel above the first cut, wherein the first cut is continuous and approximately half the length of the hinge line. Another known anti-buckling feature in U.S. Pat. No. 5,221,040 includes a cut along a hinge line joining the tray and the cover, and at least one cut in a back panel that is generally coextensive with the hinge line cut. However, none of these known anti-buckling features includes a series of straight lines and/or includes a series of straight cut lines that extends more than half the length of the hinge line.

BRIEF DESCRIPTION OF THE INVENTION

In one aspect, a blank of sheet material for forming a container is provided. The blank includes a tray panel assembly, a cover panel assembly, a fold line connecting the tray panel assembly and the cover panel assembly, and an anti-buckling mechanism interrupting the fold line. The anti-buckling mechanism includes a series of cuts positioned at least partially below the fold line in the tray panel assembly. The series of cuts extends more than half a length of the fold line. Each cut of the series of cuts is substantially straight. The anti-buckling mechanism further includes an upper cut line defined in the cover panel assembly.

In another aspect, a container formed from a blank of sheet material is provided. The blank includes a lower tray, an upper cover, a fold line connecting the lower tray and the upper cover, and an anti-buckling mechanism interrupting the fold line. The anti-buckling mechanism includes a series of cuts positioned at least partially below the fold line in the lower tray. The series of cuts extends more than half a length of the fold line. Each cut of the series of cuts is substantially straight. The anti-buckling mechanism further includes an upper cut line defined in the upper cover.

BRIEF DESCRIPTION OF THE DRAWINGS

FIG. 1 is a top view of an interior surface of an exemplary blank of sheet material for forming an exemplary anti-buckle container.

FIG. 2 is a back view of an exemplary anti-buckle container formed from the blank shown in FIG. 1 in a closed configuration.

FIG. 3 is a perspective view of the anti-buckle container shown in FIG. 2 in an open configuration.

FIG. 4 is a close-up perspective view of an interior of the anti-buckle container shown in FIG. 3.

FIG. 5 is a blown-up view of the anti-buckle container shown in FIG. 4 taken at area 5.

FIG. 6 is a close-up perspective view of an exterior of the anti-buckle container shown in FIG. 3.

FIG. 7 is a top view of an interior surface of a first alternative blank of sheet material for forming a first alternative anti-buckle container.

FIG. 8 is a top view of an interior surface of a second alternative blank of sheet material for forming a second alternative anti-buckle container.

FIG. 9 is a back view of an exemplary anti-buckle container formed from the blank shown in FIG. 8 in the closed configuration.

FIG. 10 is a top view of an interior surface of a third alternative blank of sheet material for forming a third alternative anti-buckle container.

FIG. 11 is a back view of an exemplary anti-buckle container formed from the blank shown in FIG. 10 in the closed configuration.

FIG. 12 is a perspective view of an interior of the anti-buckle container shown in FIG. 11 in an open configuration.

FIG. 13 is a perspective view of an exterior of the anti-buckle container shown in FIG. 12 in the open configuration.

FIG. 14 is a top view of an interior surface of a fourth alternative blank of sheet material for forming a fourth alternative anti-buckle container.

FIG. 15 is a back view of an exemplary anti-buckle container formed from the blank shown in FIG. 14 in the closed configuration.

FIG. 16 is a perspective view of an interior of the anti-buckle container shown in FIG. 15 in an open configuration.

FIG. 17 is a perspective view of an exterior of the anti-buckle container shown in FIG. 16 in the open configuration.

DETAILED DESCRIPTION OF THE INVENTION

Figure 1:
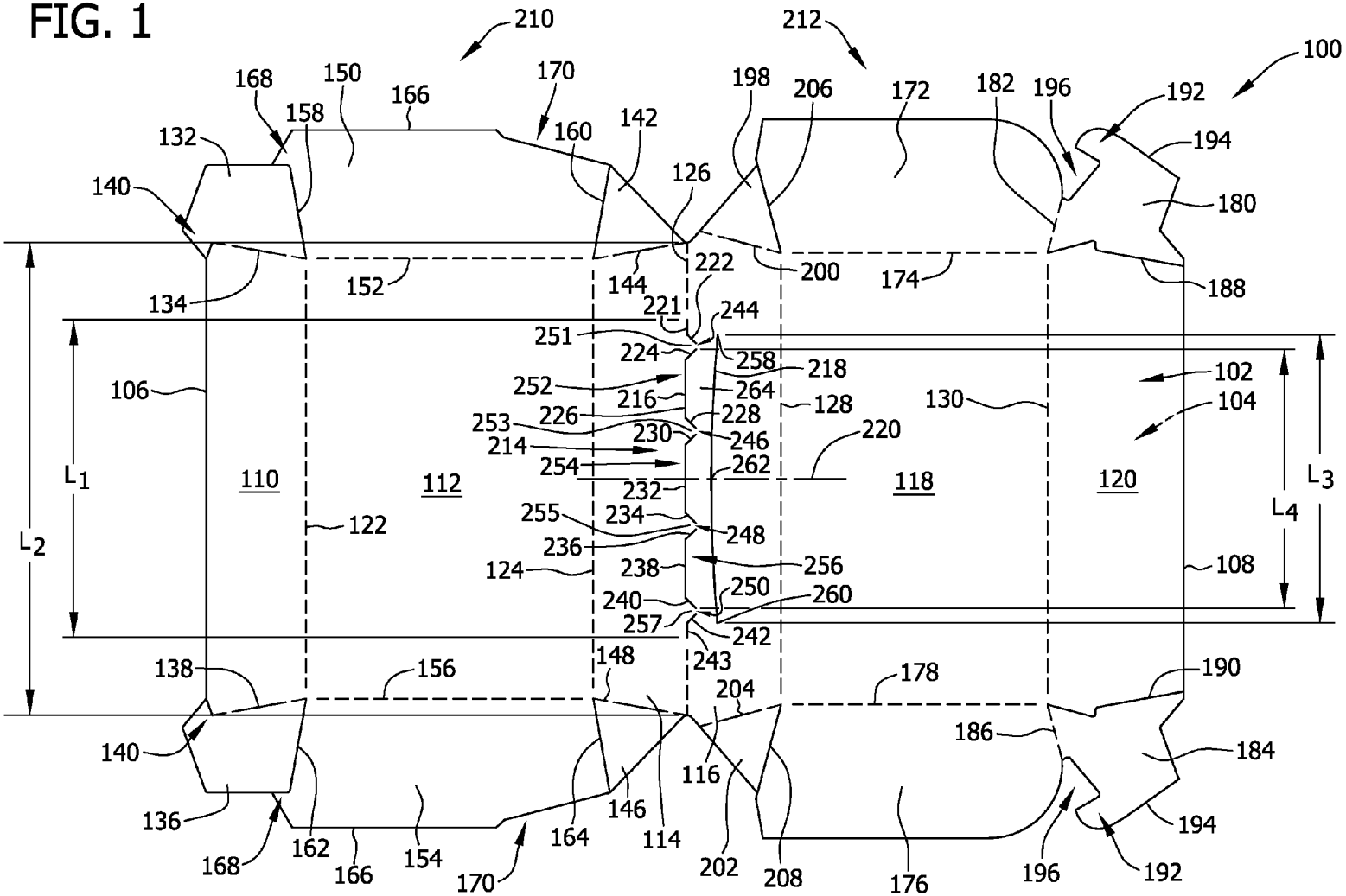
FIGS. 1-17 show exemplary embodiments of the blanks and containers described herein.

The containers described herein are configured to contain a product, such as a food product, therein. Each container includes an anti-buckling mechanism that facilitates preventing rear panels of the container from buckling along a fold line connecting the rear panels, and consequently, facilitates opening and closing the clamshell-type container. The anti-buckling mechanism can be defined in any suitable container having an upper rear panel and a lower rear panel connected along a fold line, and is not limited to being included on the clamshell-type containers described herein.

Clamshell containers formed from a single blank of sheet material and methods for constructing the container are described herein. In one embodiment, the blanks are fabricated from a paperboard material. The blanks, however, may be fabricated using any suitable material, and therefore are not limited to a specific type of material. In alternative embodiments, the blanks are fabricated using cardboard, plastic, fiberboard, paperboard, foamboard, corrugated paper, mineral-filled plastic, and/or any suitable material known to those skilled in the art and guided by the teachings herein provided.

In an example embodiment, the clamshell container includes at least one marking thereon including, without limitation, indicia that communicates the product stored in the tray, a manufacturer of the product, and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, pen and ink, painting, offset lithography, flexography, relief print, rotogravure, dye transfer, and/or any suitable printing technique known to those skilled in the art and guided by the teachings herein provided. In another embodiment, the clamshell container is void of markings, such as, without limitation, indicia that communicates the product, a manufacturer of the product and/or a seller of the product.

The containers described herein can have various overall dimensions and still include the exemplary anti-buckling mechanisms. For example, the containers can range from a smaller container, being approximately 3 inches wide by varying depths, to a larger container, being approximately 10 inches wide by varying depths. These various-dimensioned containers would still include the general anti-buckling features described herein, but in the case of the larger containers may include additional hinge tab cut lines and fingers, as compared to smaller containers. For example, cartons having a width ranging between about 3 inches and about 4 inches may include two hinge tab cut lines that define three fingers; cartons having a width ranging between about 4 inches and about 5 inches may include three hinge tab cut lines that define four fingers; cartons having a width ranging between about 5 inches and about 7 inches may include four hinge tab cut lines that define five fingers; and cartons having a width ranging between about 7 inches and about 10 inches may include five hinge tab cut lines that define six fingers. The hinge tab cut lines and fingers are described in more detail below with respect to FIG. 1. In addition, in various-dimensioned containers, a length of each individual hinge tab cut line typically ranges between about 1 inch to about 1¼ inches. Center tab cut line(s) have a length that is substantially equal to, or greater than by up to approximately 15%, outer hinge tab cut lines. All other dimensions discussed herein would be substantially consistent over the range of differently sized of containers.

FIG. 1 is a top view of an interior surface of an exemplary blank 100 of sheet material for forming an exemplary embodiment of an anti-buckle container, such as container 300 (shown in FIGS. 2-6). Blank 100 has a first or interior surface 102 and an opposing second or exterior surface 104. Further, blank 100 defines a first edge 106 and an opposing second edge 108. In one embodiment, blank 100 includes, in series from first edge 106 to second edge 108, a lower front panel 110, a bottom panel 112, a lower rear panel 114, an upper rear panel 116, a top panel 118, and an upper front panel 120 coupled together along preformed, generally parallel, fold lines 122, 124, 126, 128, and 130, respectively. Fold lines 122, 124, 126, 128, and/or 130, as well as other fold lines and/or hinge lines described herein, may include any suitable crease, line of weakening, and/or line of separation known to those skilled in the art and guided by the teachings herein provided. More specifically, lower front panel 110 extends from first edge 106 to fold line 122, bottom panel 112 extends from lower front panel 110 along fold line 122, lower rear panel 114 extends from bottom panel 112 along fold line 124, upper rear panel 116 extends from lower rear panel 114 along fold line 126, top panel 118 extends from upper rear panel 116 along fold line 128, and upper front panel 120 extends from top panel 118 along fold line 130 to second edge 108.

A first lower front coupling tab 132 extends from a first side edge of lower front panel 110 along a fold line 134, and a second lower front coupling tab 136 extends from a second side edge of lower front panel 110 along a fold line 138. Each lower front coupling tab 132 and 136 includes a closure hook 140 extending therefrom. Similarly, a first lower rear coupling tab 142 extends from a first side edge of lower rear panel 114 along a fold line 144, and a second lower rear coupling tab 146 extends from a second side edge of lower rear panel 114 along a fold line 148.

A first lower side panel 150 extends from a first side edge of bottom panel 112 at a fold line 152, and a second lower side panel 154 extends from a second side edge of bottom panel 112 at a fold line 156. A cut line 158 separates first lower side panel 150 from first lower front coupling tab 132, and a cut line 160 separates first lower side panel 150 from first lower rear coupling tab 142. Similarly, a cut line 162 separates second lower side panel 154 from second lower front coupling tab 136, and a cut line 164 separates second lower side panel 154 from second lower rear coupling tab 146. Each lower side panel 150 and 154 includes a free edge 166 that partially defines a closure hook 168 each having a similar shape to closure hooks 140. Free edge 166 further defines a cutout 170 configured to allow container 300 to be positioned in a closed configuration and/or vent contents of container 300.

A first upper side panel 172 extends from a first side edge of top panel 118 at a fold line 174, and a second upper side panel 176 extends from a second side edge of top panel 118 at a fold line 178. A first upper front coupling tab 180 extends from a front edge of first upper side panel 172 along a fold line 182, and a second upper front coupling tab 184 extends from a front edge of second upper side panel 176 along a fold line 186. A cut line 188 separates first upper front coupling tab 180 from upper front panel 120, and a cut line 190 separates second upper front coupling tab 184 from upper front panel 120. Each upper front coupling tab 180 and 184 includes a closure projection 192 defined along a free edge 194 thereof. A notch 196 is defined adjacent to closure projection 192 and is configured to receive a pair of closure hooks 140 and 168 when container 300 is formed and in the closed configuration. Alternatively, blank 100 includes any suitable closure and/or locking mechanism that enables container 300 to be secured in the closed configuration. For example, the locking mechanism, such as a slot (not shown) defined along fold line 130, in top panel 118, and/or in upper front panel 120 and a tab (not shown) extending from lower front panel 110 and configured to be inserted into the slot, such as the tab-and-slot locking mechanism shown in FIGS. 7 and 10.

In the exemplary embodiment, a first upper rear coupling tab 198 extends from a first side edge of upper rear panel 116 along a fold line 200, and a second upper rear coupling tab 202 extends from a second side edge of upper rear panel 116 along a fold line 204. A cut line 206 separates first upper side panel 172 from first upper rear coupling tab 198, and a cut line 208 separates second upper side panel 176 from second upper rear coupling tab 202. Panels 110, 112, 114, 150, and 154 and tabs 132, 136, 142, and 146 define a bottom tray panel assembly 210, and panels 116, 118, 120, 172, and 176 and tabs 180, 184, 198, and 202 define a top cover panel assembly 212. Bottom tray panel assembly 210 and top cover panel assembly 212 are connected along fold line 126.

An anti-buckling mechanism 214 is defined adjacent fold line 126 and in rear panels 114 and 116. More preferably, anti-buckling mechanism 214 includes a series 216 of cuts interrupting fold line 126 and an upper cut line 218 defined in upper rear panel 116. Series 216 and upper cut line 218 are configured to prevent rear panel 114 and/or 116 from buckling at fold line 126 when container 300 is transitioned between an open configuration and the closed configuration. Further, series 216 and upper cut line 218 are symmetric about an axis 220 that is substantially perpendicular to fold lines 124 and 128 and positioned at a center of rear panels 114 and 116. As such, series 216 and upper cut line 218 are symmetric about a central vertical axis 220.

In the exemplary embodiment, series 216 has a length $L_1$ that is longer than half a length $L_2$ of fold line 126. Similarly, upper cut line 218 has a length $L_3$ that is longer than half length $L_2$ of fold line 126. In the exemplary embodiment, length $L_1$ is substantially equal to or longer than length $L_3$. In the embodiment shown in FIG. 1, length $L_1$ is longer than length $L_3$ by about ¼ inch. Series 216 includes a leading horizontal cut 221, a first upward cut 222, a first downward cut 224, a first horizontal cut 226, a second upward cut 228, a second downward cut 230, a second horizontal cut 232, a third upward cut 234, a third downward cut 236, a third horizontal cut 238, a fourth upward cut 240, a fourth downward cut 242, and a trailing horizontal cut 243. As used herein, the term "upward" refers to a direction from lower rear panel 114 toward upper rear panel 116 at a non-orthogonal angle to fold line 126, and the term "downward" refers to a direction from upper rear panel 116 toward lower rear panel 114 at a non-orthogonal angle to fold line 126. In a particular embodiment, each upward cut 222, 228, 234, and 240 and each downward cut 224, 230, 236, and 242 is at substantially 45° to horizontal cuts 221, 226, 232, 238, and 243.

A length $L_4$ is defined between an end of first downward cut 224 and an end of fourth upward cut 240. Length $L_4$ is longer than half of length $L_2$. Further, length $L_3$ is substantially equal to or longer than length $L_4$. In the embodiment shown in FIG. 1, length $L_3$ is longer than length $L_4$ by, for example, about ¼ inch. Further, each horizontal cut is substantially horizontal within manufacturing tolerances. Each horizontal cut 221, 226, 232, 238, and 243 is offset from fold line 126 into lower rear panel 114. More specifically, the offset from fold line 126 ranges between about 0.89% and about 2.5% of a height of lower rear panel 114. In the embodiment shown in FIG. 1, each horizontal cut 221, 226, 232, 238, and 243 is offset from fold line 126 by about 1/64 inch. Cuts 221, 222, 224, 226, 228, 230, 232, 234, 236, 238, 240, 242, and 243 are configured to define at least two continuous cut lines, as described in more detail below. Such continuous cut lines are also described herein as hinge tab cut lines.

First upward cut 222 and first downward cut 224 have a first gap 244 defined therebetween such that a portion of material separates first upward cut 222 and first downward cut 224, second upward cut 228 and second downward cut 230 have a second gap 246 defined therebetween such that a portion of material separates second upward cut 228 and second downward cut 230, third upward cut 234 and third downward cut 236 have a third gap 248 defined therebetween such that a portion of material separates third upward cut 234 and third downward cut 236, and fourth upward cut 240 and fourth downward cut 242 have a fourth gap 250 defined therebetween such that a portion of material separates fourth upward cut 240 and fourth downward cut 242. In particular embodiments, each gap 244, 246, 248, and 250 has a length ranging between about 1/32 inch and about 3/16 inch. In the embodiment shown in FIG. 1, each gap 244, 246, 248, and 250 has a length of about 1/16 inch.

First downward cut 224, first horizontal cut 226, and second upward cut 228 define a first continuous cut line 252; second downward cut 230, second horizontal cut 232, and third upward cut 234 define a second continuous cut line 254; and third downward cut 236, third horizontal cut 238, and fourth upward cut 240 define a third continuous cut line 256. A finger 251, 253, 255, and 257 is defined by the portions of material between each adjacent continuous cut line 252, 254, and 256. Each finger 251, 253, 255, and 257 each have a height configured to cause arcing of a strap 264 with respect to the remainder of upper rear panel 116, arcing of upper rear panel 116 upward toward lower rear panel 114, and/or arcing of lower rear panel 114 upward toward upper rear panel 116 in the open position, as described in more detail below. In particular embodiments, each finger 251, 253, 255, and 257 has a height ranging between about 1/16 inch and about ¼ inch. In the embodiment shown in FIG. 1, each finger 251, 253, 255, and 257 has a height of about ⅛ inch. Accordingly, the height of fingers 251, 253, 255, and 257 ranges between about 7% and about 20% of a height of upper rear panel 116.

Figure 7:
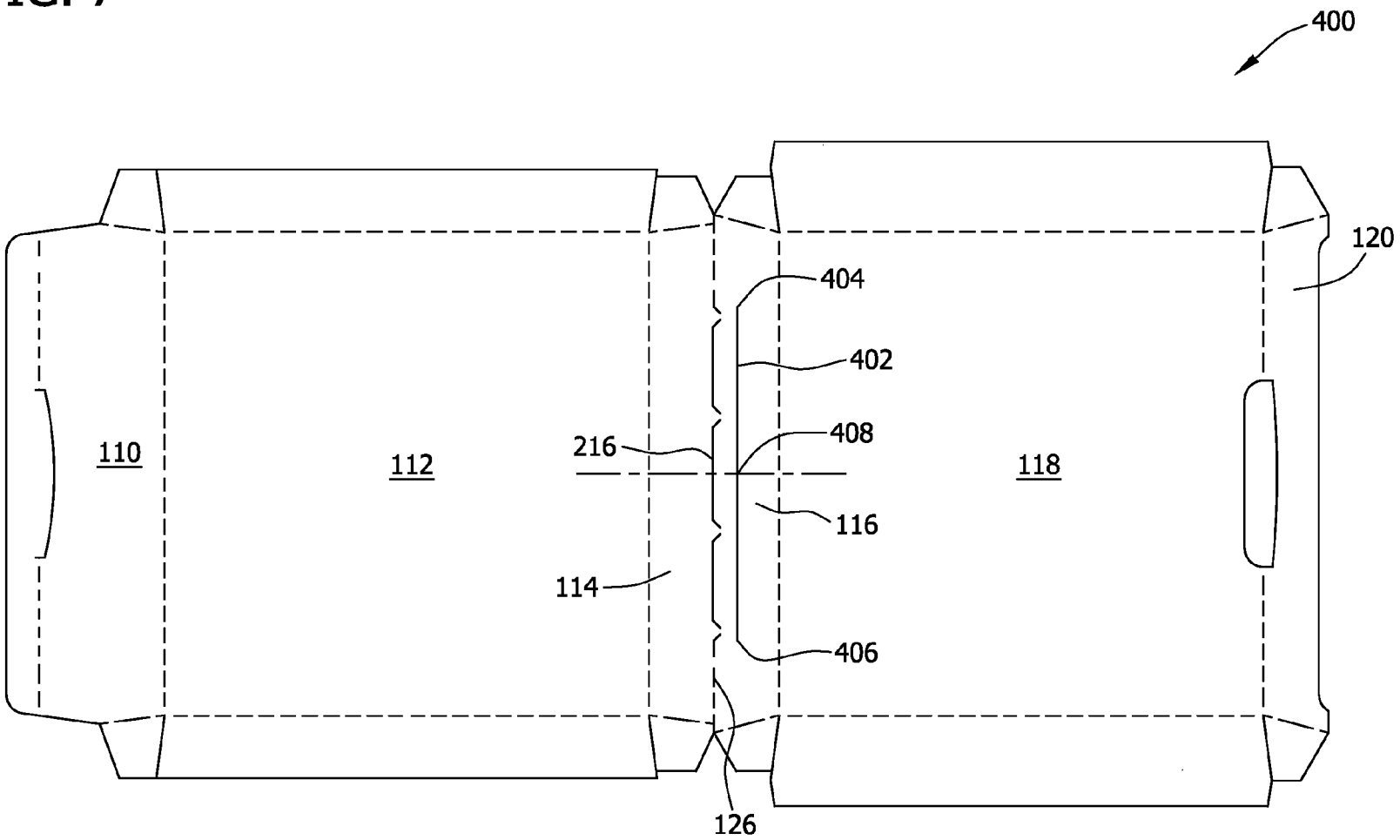
Figure 8:
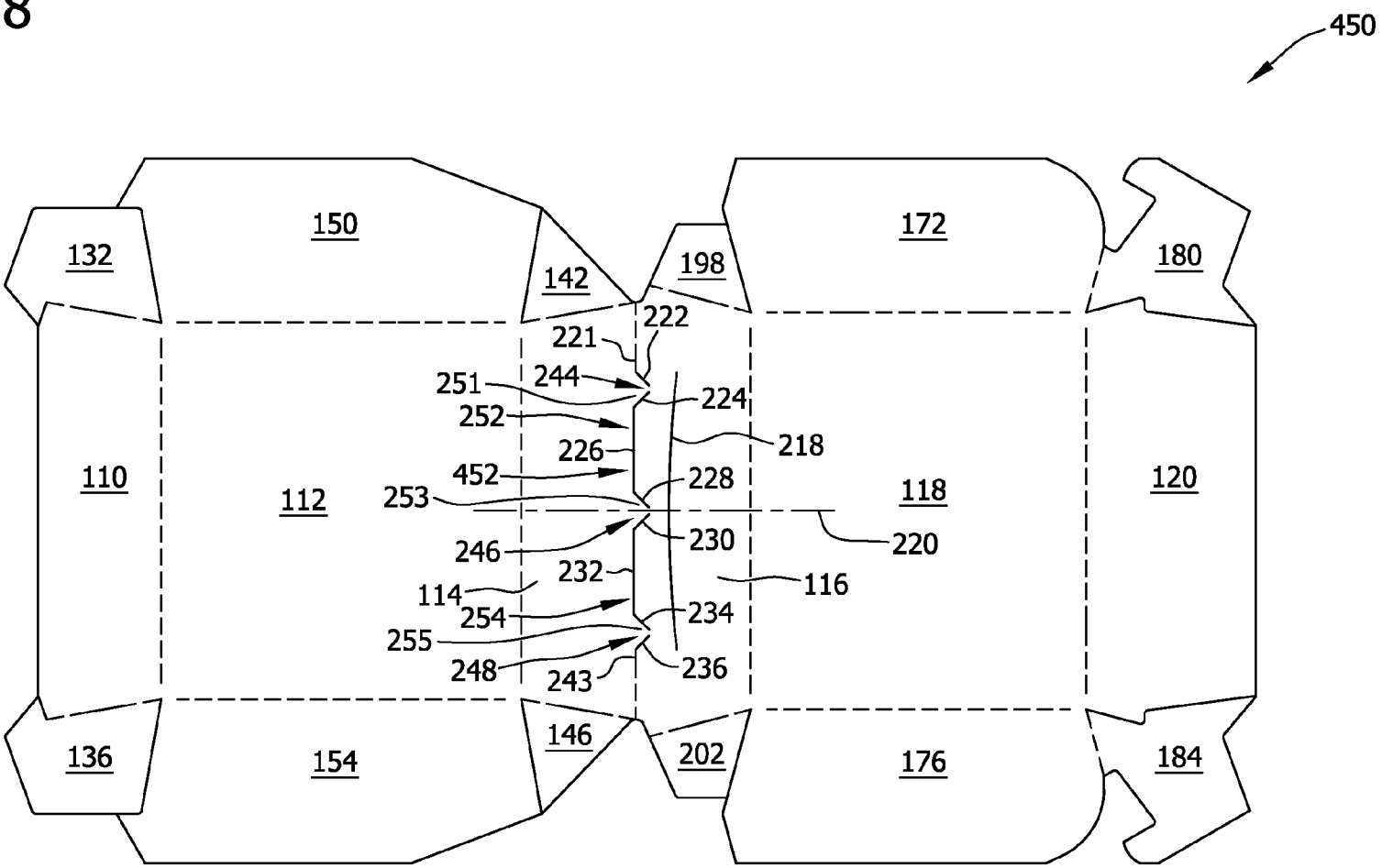
Figure 9:
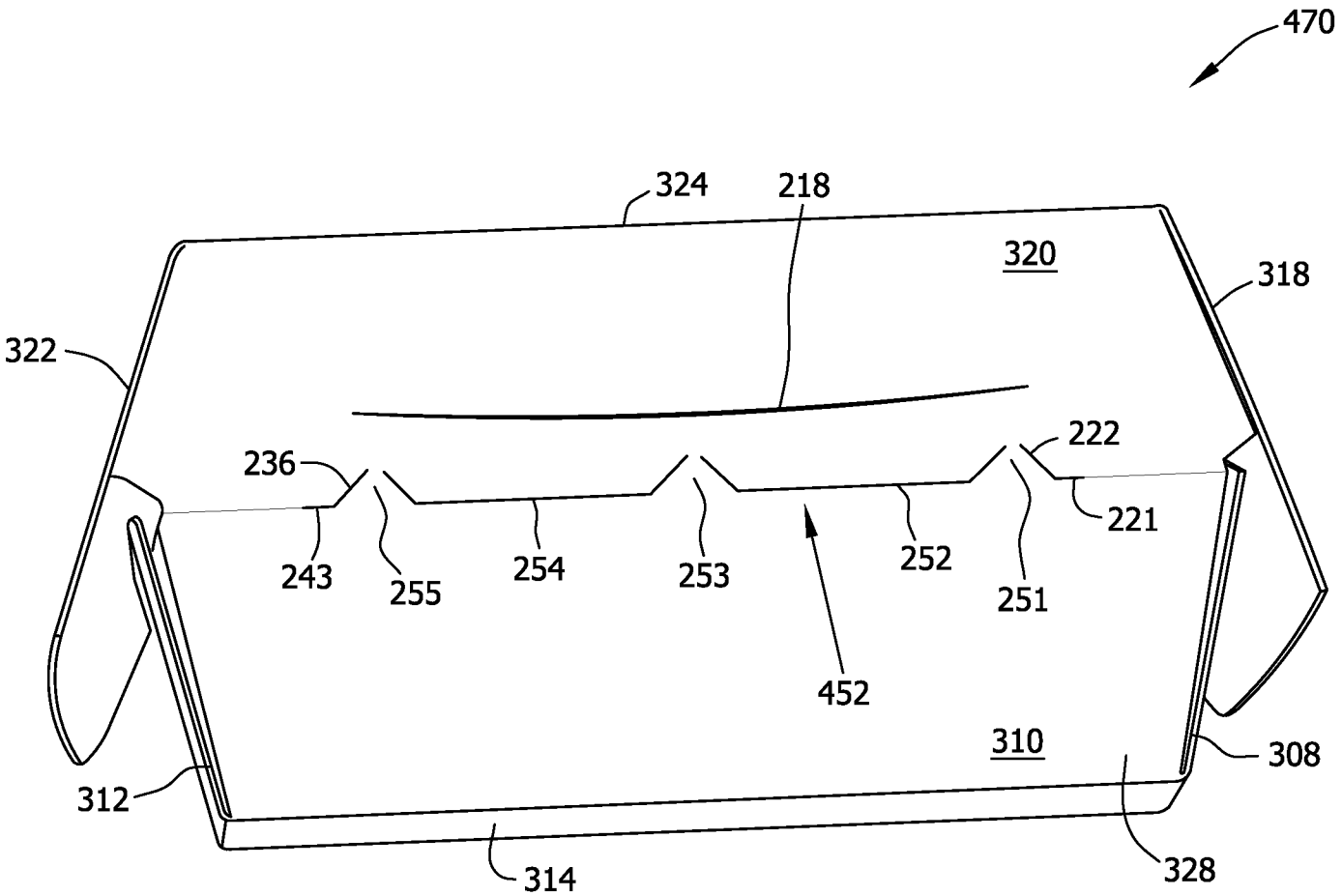

Upper cut line 218 includes a first end 258, a second end 260, and a mid-point 262 approximately half way between first end 258 and second end 260. Upper cut line 218 is arcuate between ends 258 and 260 such that mid-point 262 is nearer series 216 than ends 258 and 260 are. Some alternative embodiments of anti-buckling mechanism 214 are shown in FIGS. 7-9. In the exemplary embodiment, upper cut line 218 is positioned a distance from fold line 126 at mid-point 262. In the embodiment shown in FIG. 1, upper cut line 218 is positioned about ¼ inch from fold line 126 at mid-point 262. As such, strap 264 of material is defined between upper cut line 218 and series 216. Strap 264 is configured to move with respect to the remainder of upper rear panel 116 during the opening and closing process, as described in more detail herein.

As discussed above, the exemplary dimensions are substantially consistent for containers having a bottom panel width of between about 3 inches and about 10 inches, while the number of gaps and continuous cut lines and/or the number of fingers depends on the size of the blank. For example, a smaller blank may have three fingers, and a larger blank may have five fingers. However, the height of the fingers, the length of the gaps, the offset from fold line 126, and the position of upper cut line 218 would be substantially the same, as discussed above. An example of a blank having three fingers is shown in FIGS. 8 and 9.

Figure 2:
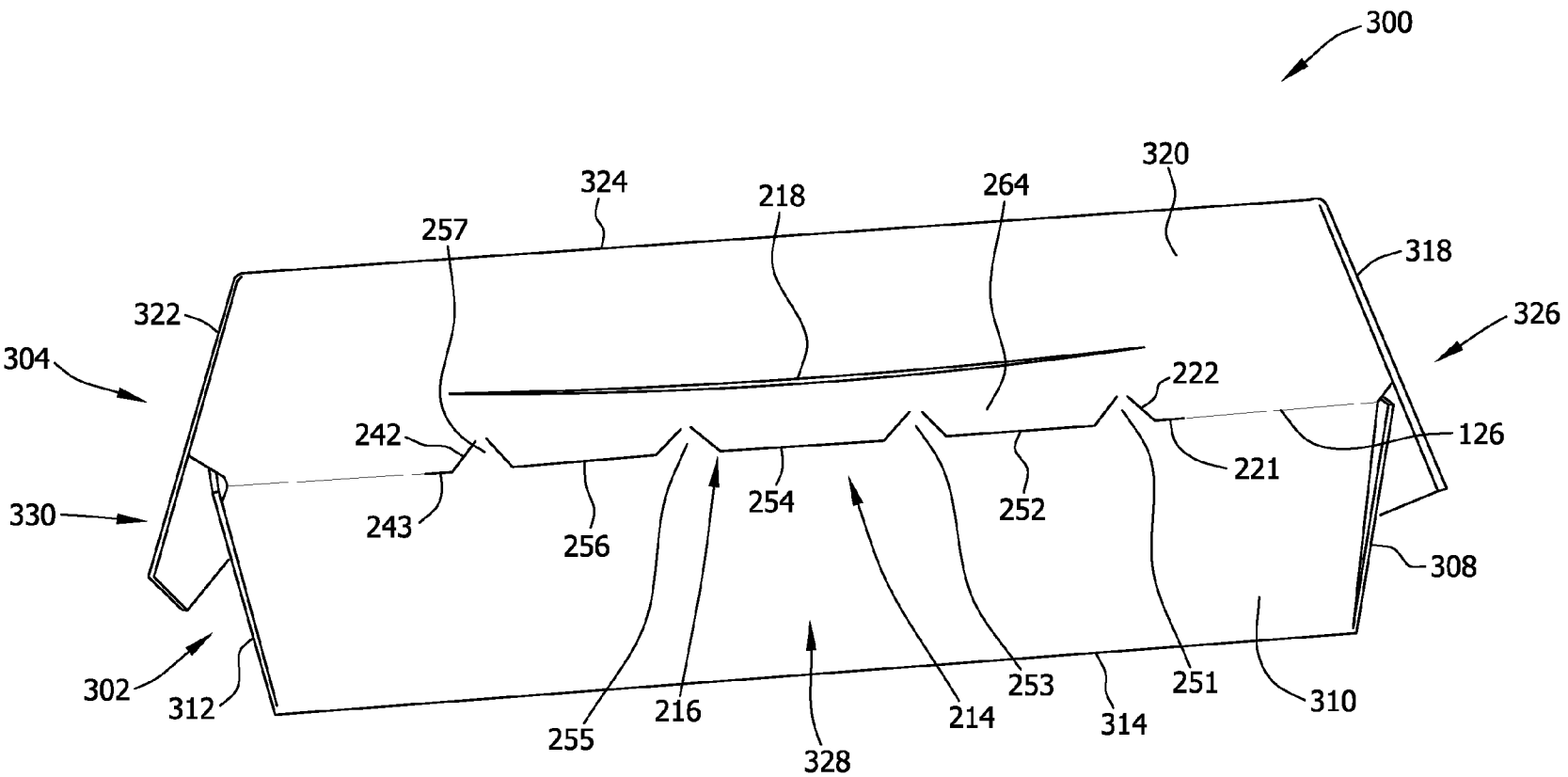
Figure 3:
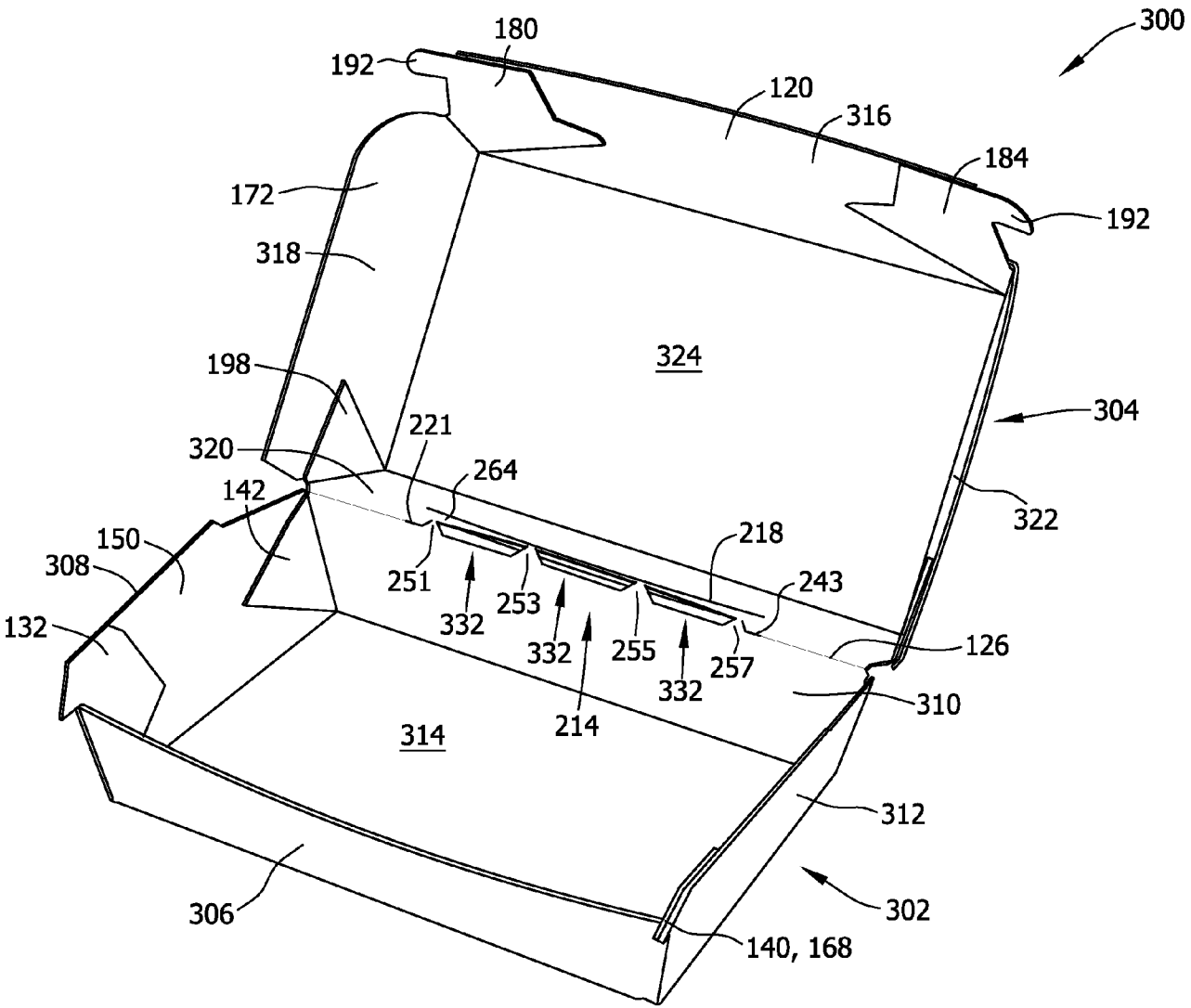
Figure 4:
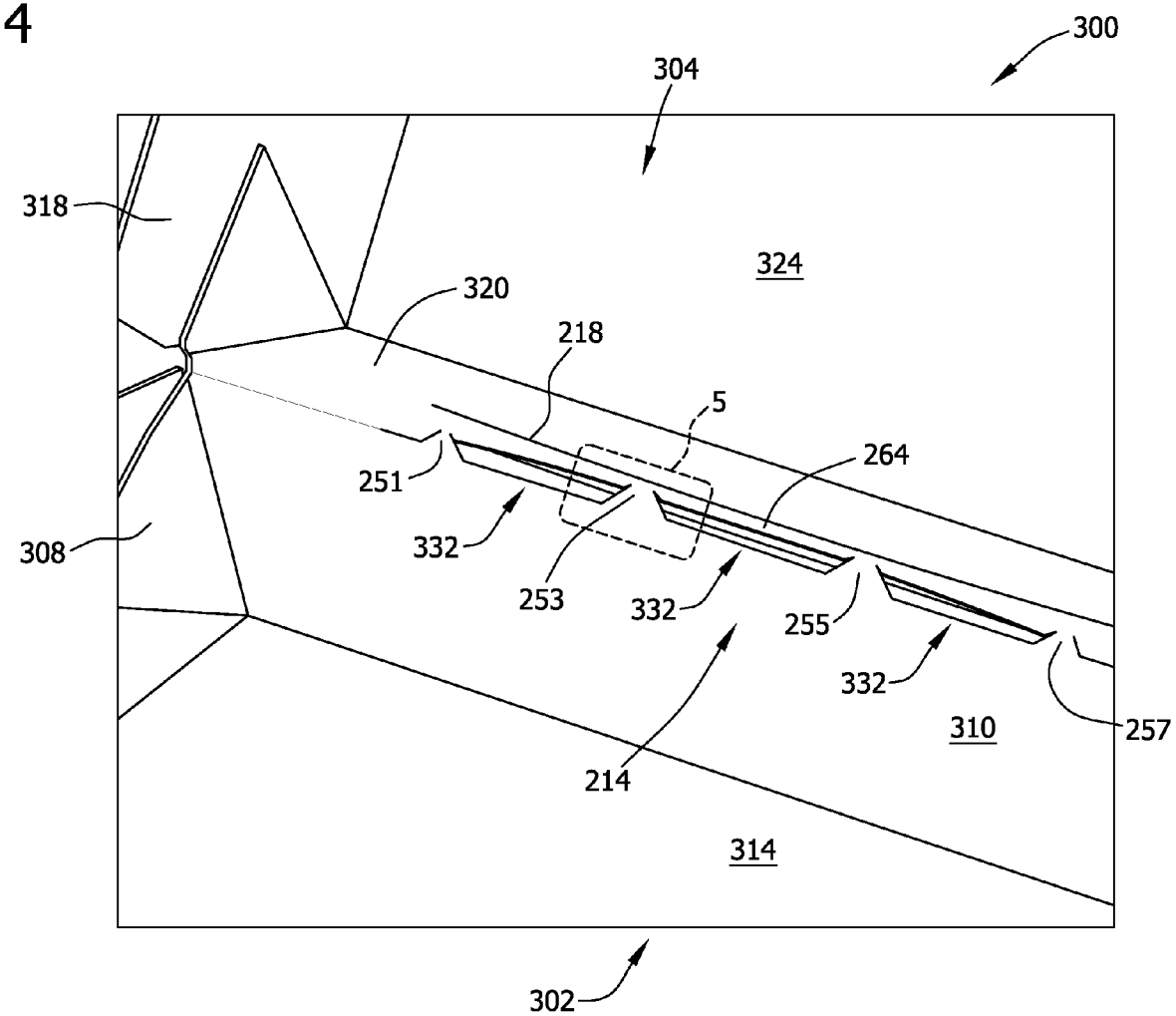
Figure 5:
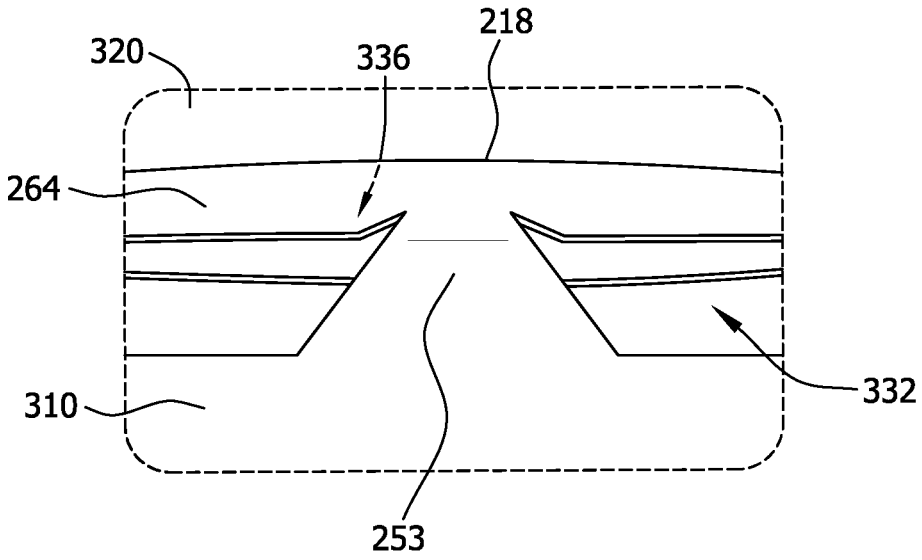
Figure 6:
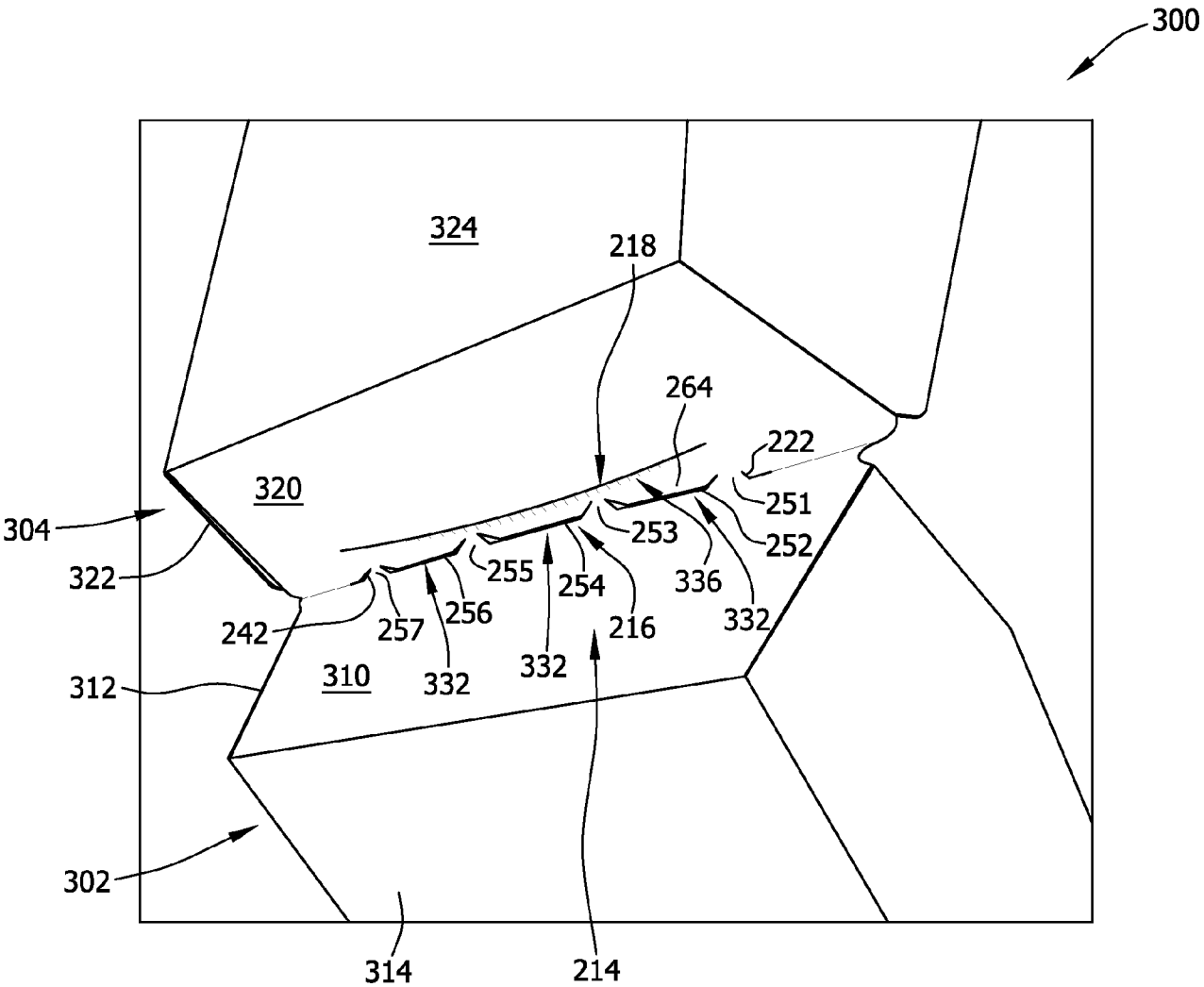

FIG. 2 is a back view of an exemplary anti-buckle container 300 formed from blank 100 (shown in FIG. 1) in the closed configuration. FIG. 3 is a perspective view of container 300 in the open configuration. FIG. 4 is a close-up perspective view of container 300. FIG. 5 is a blown-up view of container 300 taken at area 5 in FIG. 4. FIG. 6 is a close-up perspective view of an exterior of container 300. Container 300 includes a bottom tray 302 and a top cover 304 connected to each other at fold line 126 and/or anti-buckling mechanism 214. Tray 302 includes a lower front wall 306, a first lower side wall 308, a lower rear wall 310, a second lower side wall 312, and a bottom wall 314. Cover 304 includes an upper front wall 316, a first upper side wall 318, an upper rear wall 320, a second upper side wall 322, and a top wall 324. In the closed configuration, lower front wall 306 and upper front wall 316 form a front wall (not shown), first lower side wall 308 and first upper side wall 318 form a first side wall 326, lower rear wall 310 and upper rear wall 320 form a rear wall 328, and second lower side wall 312 and second upper side wall 322 form a second side wall 330.

In the exemplary embodiment, first lower side wall 308 includes first lower front coupling tab 132 and first lower rear coupling tab 142 coupled to first lower side panel 150. Similarly, second lower side wall 312 includes second lower front coupling tab 136 (shown in FIG. 1) and second lower rear coupling tab 146 (shown in FIG. 1) coupled to second lower side panel 154 (shown in FIG. 1). Closure hooks 140 and 168 align with each other. Upper front wall 316 includes first upper front coupling tab 180 and second upper front coupling tab 184 coupled to front panel 120. Upper front wall 316 further includes closure projection 192 extending from each side thereof. First upper side wall 318 includes first upper rear coupling tab 198 coupled to first upper side panel 172, and second upper side wall 322 includes second upper rear coupling tab 202 (shown in FIG. 1) coupled to second upper side panel 176 (shown in FIG. 1).

Referring to FIG. 2, in the closed configuration rear walls 310 and 320 are substantially in contact with each other at series 216. Referring to FIGS. 3-6, in the open configuration, openings 332 are defined at cut lines 252, 254, and/or 256 and four substantially wedge-shaped fingers 251, 253, 255, and 257 of material are defined between openings 332. Further, an upper opening 336 may be defined at upper cut line 218. Openings 332 and/or upper opening 336 enable container 300 to be transitioned between the closed configuration and the open configuration without buckling at lower rear wall 310, upper rear wall 320, and/or fold line 126 by allowing strap 264 to move with respect to rear walls 310 and/or 320.

More specifically, as shown in FIGS. 3 and 4, fingers 253 and 255 push strap 264 upwards causing strap 264 to become arcuately-shaped from leading horizontal cut 221 to trailing horizontal cut 243. Because of the arcuate shape of strap 264, a central opening 332 and upper opening 336 have a width that is largest proximate to axis 220 (shown in FIG. 1). As shown in FIGS. 5 and 6, strap 264 is pushed upward relative to upper rear wall 320 by fingers 253 and 255. In other words, fingers 253 and 255 are configured to push strap 264 upward from the remaining portion of upper rear wall 320 to prevent buckling of container 300 at rear walls 310 and 320.

Further, fingers 251, 253, 255, and/or 257 pull lower rear wall 310 upwards towards upper cover 304 as container 300 is opened. More specifically, tray 302 is rotating with respect to cover 304 at gaps 244, 246, 248, and 250 rather than at fold line 126, and the higher fold over action causes arcing of lower rear wall 310 and/or upper rear wall 320. Further, although there may be a fold line present at each gap 244, 246, 248 and 250, the material of blank 100 rolls upward on itself to its weakest point at each gap 244, 246, 248 and 250 thereby creating a soft bend, rather than a sharp fold or crease, in the material. The rolling of the material facilitates eliminating binding in rear wall 328 because the soft edge and the bend cause separation within the material.

FIG. 7 is a top view of an interior surface of a first alternative blank 400 of sheet material for forming a first alternative anti-buckle container. Blank 400 is substantially similar to blank 100 (shown in FIG. 1), except blank 400 includes a substantially straight upper cut line 402 and a tab-and-slot locking mechanism. The tab-and-slot locking mechanism is described in more detail with respect to FIG. 10. Further, blank 400 includes a different configuration of coupling tabs, as described in more detail with respect to FIG. 10. As such, components shown in FIG. 7 are labeled with the same reference numbers used in FIG. 1. In the exemplary embodiment, upper cut line 402 is substantially straight between a first end 404 and a second end 406 through a mid-point 408. As such, upper cut line 402 is substantially linear.

FIG. 8 is a top view of an interior surface of a second alternative blank 450 of sheet material for forming a second alternative anti-buckle container. FIG. 9 is a back view of an exemplary anti-buckle container 470 formed from blank 450 in the closed configuration. Referring to FIG. 8, blank 450 is substantially similar to blank 100 (shown in FIG. 1), except blank 450 includes a series 452 of cuts that omits third horizontal cut 238, fourth upward cut 240, fourth gap 250, and fourth downward cut 242 (all shown in FIG. 1). As such, components shown in FIGS. 8 and 9 are labeled with the same reference numbers used in FIGS. 1-4. Referring to FIG. 9, when container 470 is formed, three substantially wedge-shaped fingers 251, 253, and 255 of material are defined in rear wall 328 by series 452.

In the exemplary embodiment, series 452 and upper cut line 218 are symmetric about axis 220. As such, second finger 253 is positioned on axis 220. Further, it should be understood that, although arcuate upper cut line 218 is shown in FIGS. 8 and 9, blank 450 and container 470 can include substantially straight upper cut line 402, as shown in FIG. 7.

Figure 10:
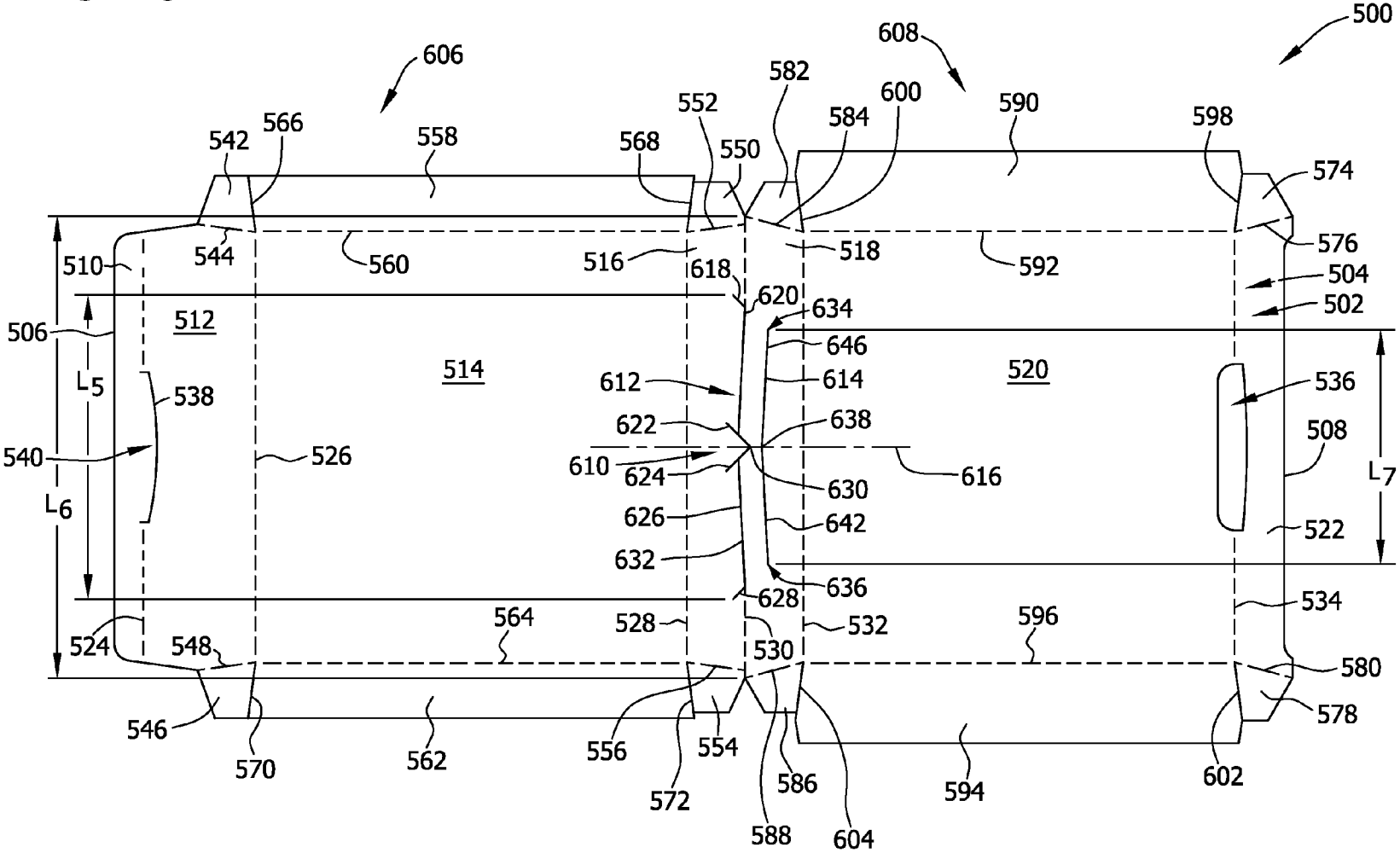
Figure 11:
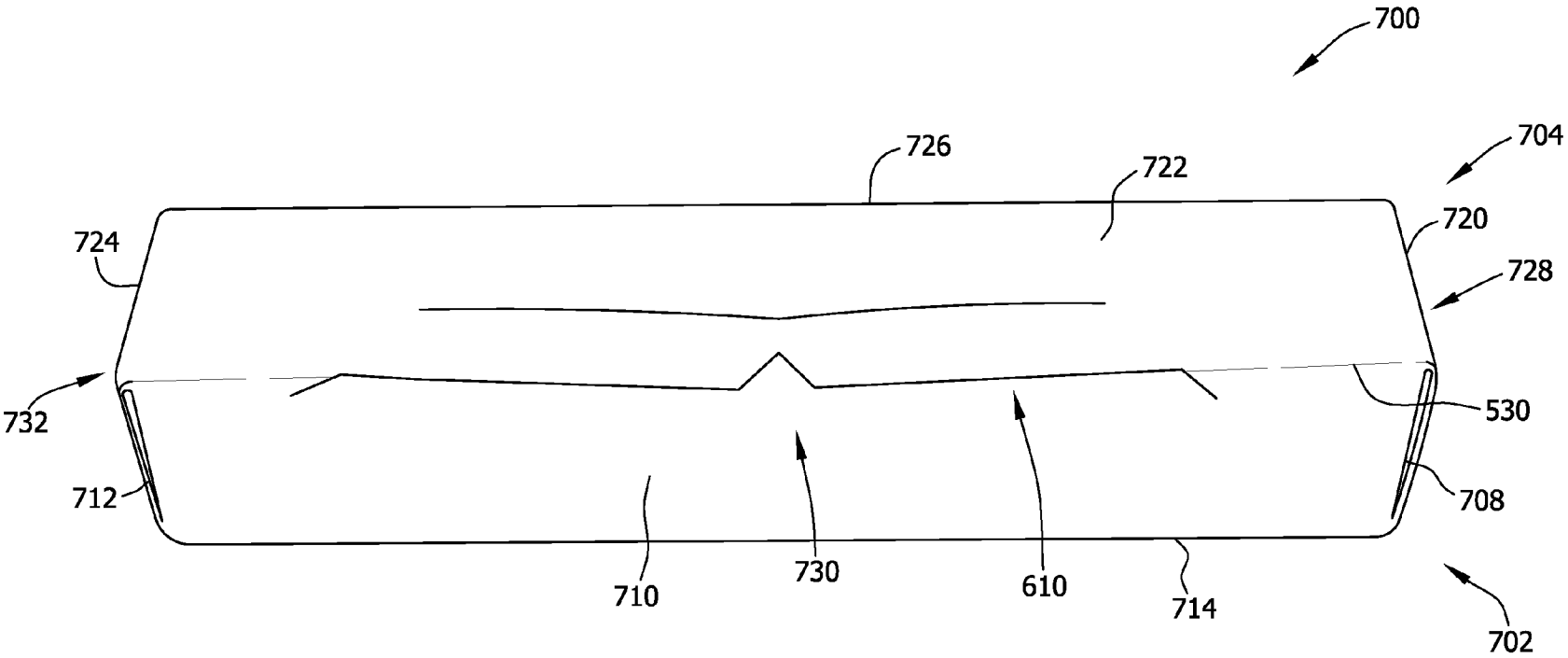
Figure 12:
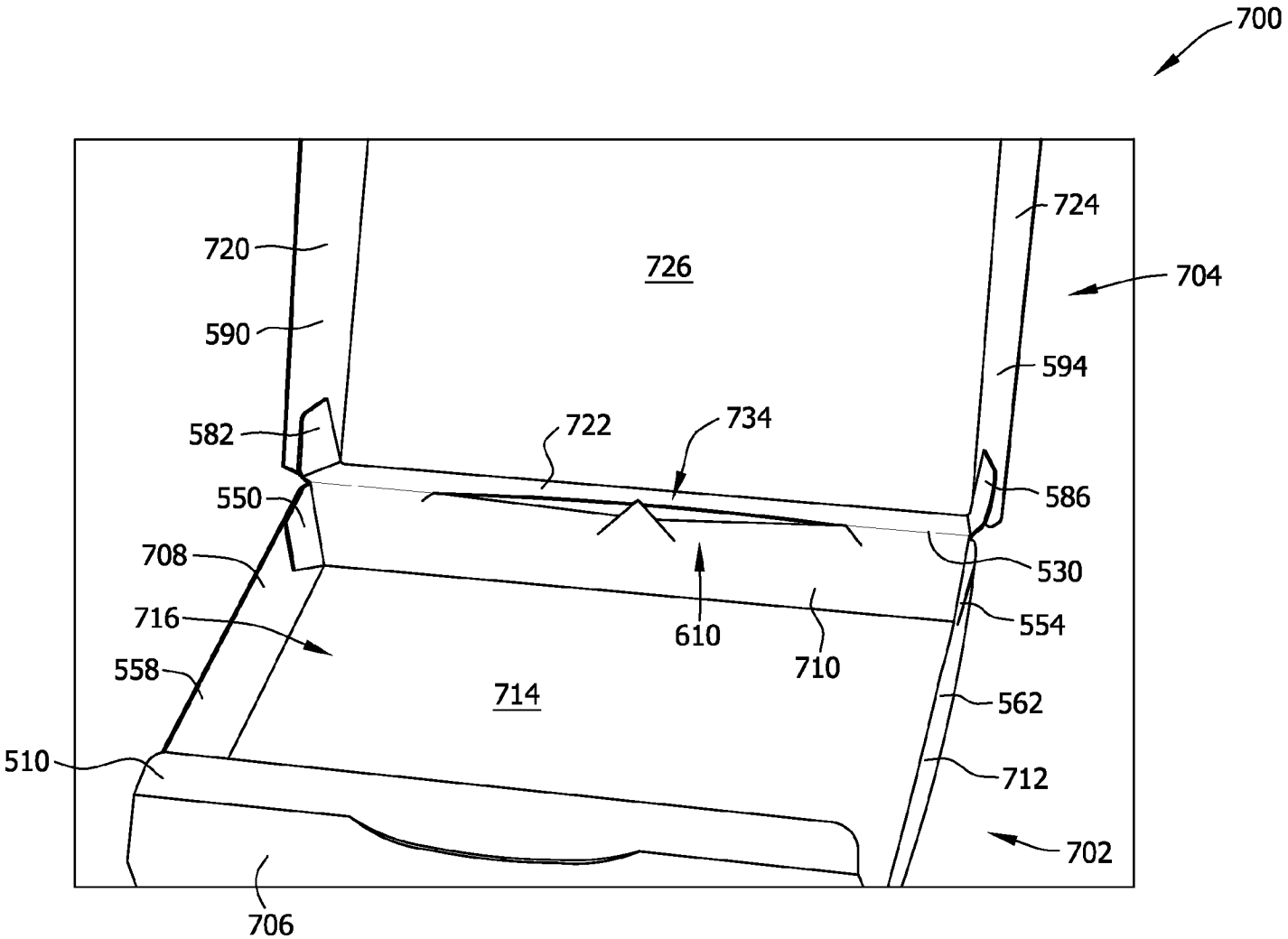
Figure 13:
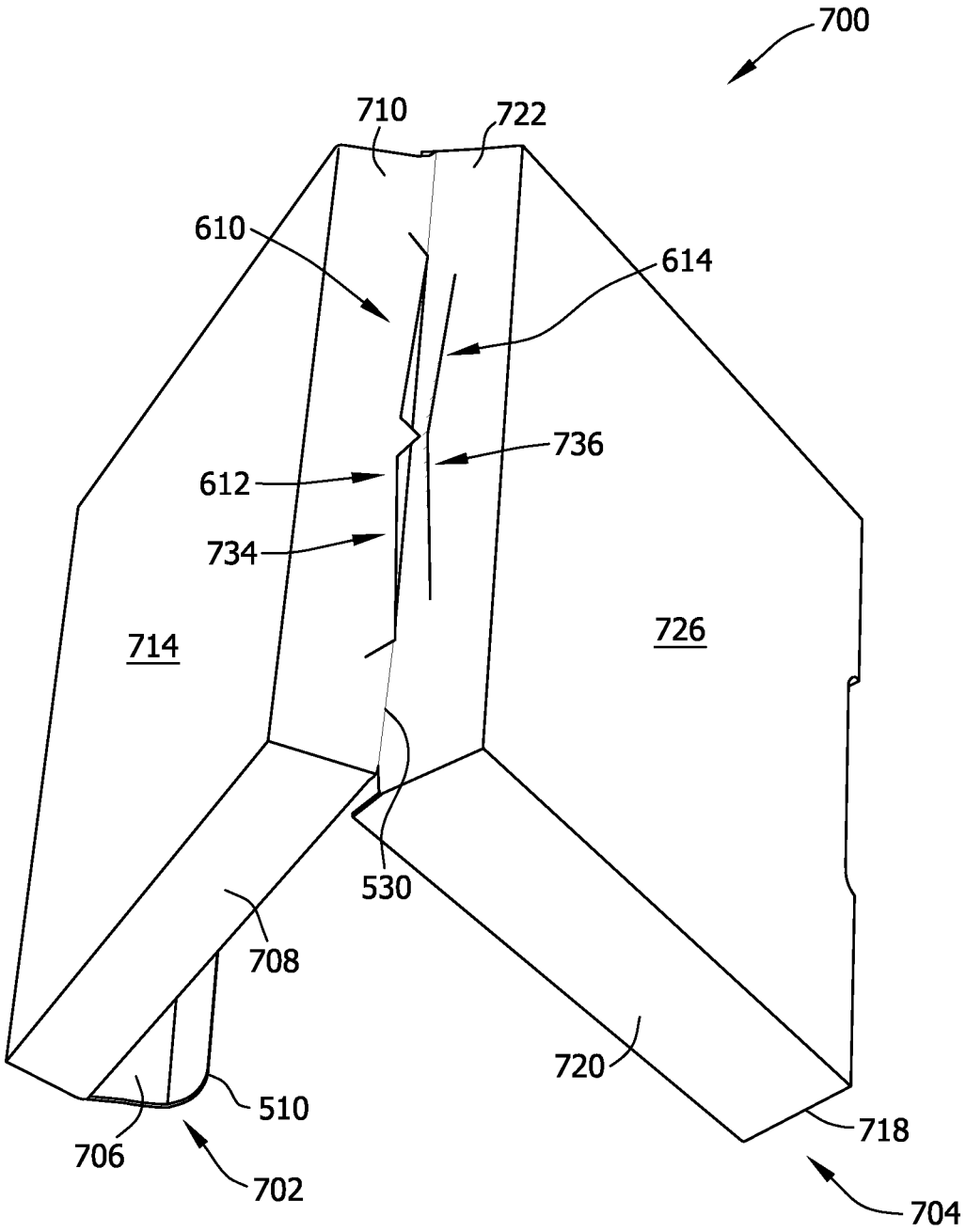

FIG. 10 is a top view of an interior surface of a third alternative blank 500 of sheet material for forming a third alternative anti-buckle container, such as container 700 (shown in FIGS. 11-13). Blank 500 has a first or interior surface 502 and an opposing second or exterior surface 504. Further, blank 500 defines a first edge 506 and an opposing second edge 508. In one embodiment, blank 500 includes, in series from first edge 506 to second edge 508, a locking flap 510, a lower front panel 512, a bottom panel 514, a lower rear panel 516, an upper rear panel 518, a top panel 520, and an upper front panel 522 coupled together along preformed, generally parallel, fold lines 524, 526, 528, 530, 532, and 534, respectively. Fold lines 524, 526, 528, 530, 532, and/or 534, as well as other fold lines and/or hinge lines described herein, may include any suitable crease, line of weakening, and/or line of separation known to those skilled in the art and guided by the teachings herein provided. More specifically, locking flap 510 extends from first edge 506 to fold line 524, lower front panel 512 extends from locking flap 510 along fold line 524, bottom panel 514 extends from lower front panel 512 along fold line 526, lower rear panel 516 extends from bottom panel 514 along fold line 528, upper rear panel 518 extends from lower rear panel 516 along fold line 530, top panel 520 extends from upper rear panel 518 along fold line 532, and upper front panel 522 extends from top panel 520 along fold line 534 to second edge 508.

A slot 536 interrupts fold line 534 and is defined in upper front panel 522 and top panel 520. A cut line 538 interrupts fold line 524 to define a tab 540 configured to be inserted into slot 536 when container 700 is formed and positioned in a closed configuration. Alternatively, blank 500 includes any suitable closure and/or locking mechanism that enables container 700 to be secured in the closed configuration, such as the hook-and-projection locking mechanism shown in FIG. 1.

A first lower front coupling tab 542 extends from a first side edge of lower front panel 512 along a fold line 544, and a second lower front coupling tab 546 extends from a second side edge of lower front panel 512 along a fold line 548. Similarly, a first lower rear coupling tab 550 extends from a first side edge of lower rear panel 516 along a fold line 552, and a second lower rear coupling tab 554 extends from a second side edge of lower rear panel 516 along a fold line 556. A first lower side panel 558 extends from a first side edge of bottom panel 514 at a fold line 560, and a second lower side panel 562 extends from a second side edge of bottom panel 514 at a fold line 564. A cut line 566 separates first lower side panel 558 from first lower front coupling tab 542, and a cut line 568 separates first lower side panel 558 from first lower rear coupling tab 550. Similarly, a cut line 570 separates second lower side panel 562 from second lower front coupling tab 546, and a cut line 572 separates second lower side panel 562 from second lower rear coupling tab 554.

A first upper front coupling tab 574 extends from a first side edge of upper front panel 522 along a fold line 576, and a second upper front coupling tab 578 extends from a second side edge of upper front panel 522 along a fold line 580. Similarly, a first upper rear coupling tab 582 extends from a first side edge of upper rear panel 518 along a fold line 584, and a second upper rear coupling tab 586 extends from a second side edge of upper rear panel 518 along a fold line 588. A first upper side panel 590 extends from a first side edge of top panel 520 at a fold line 592, and a second upper side panel 594 extends from a second side edge of top panel 520 at a fold line 596. A cut line 598 separates first upper side panel 590 from first upper front coupling tab 574, and a cut line 600 separates first upper side panel 590 from first upper rear coupling tab 582. Similarly, a cut line 602 separates second upper side panel 594 from second upper front coupling tab 578, and a cut line 604 separates second upper side panel 594 from second upper rear coupling tab 586.

Flap 510, panels 512, 514, 516, 558, and 562, and tabs 542, 546, 550, and 554 define a bottom tray panel assembly 606, and panels 518, 520, 522, 590, and 594 and tabs 574, 578, 582, 586 define a top cover panel assembly 608. Bottom tray panel assembly 606 and top cover panel assembly 608 are connected along fold line 530.

An anti-buckling mechanism 610 is defined adjacent fold line 530 and in rear panels 516 and 518. More specifically, anti-buckling mechanism 610 includes a series 612 of cuts interrupting fold line 530 and an upper cut line 614 defined in upper rear panel 518. Series 612 and upper cut line 614 are configured to prevent rear panel 516 and/or 518 from buckling at fold line 530 when container 700 is transitioned between an open configuration and the closed configuration. Further, series 612 and upper cut line 614 are symmetric about an axis 616 that is substantially perpendicular to fold lines 528 and 532 and positioned at a center of rear panels 516 and 518. As such, series 612 and upper cut line 614 are symmetric about a central vertical axis 616. In the exemplary embodiment, series 612 has a length $L_5$ that is longer than half a length $L_6$ of fold line 530. Upper cut line 614 has a length $L_7$ that is shorter than length $L_5$ of series 612.

Series 612 includes a minor upward cut 618, an intermediate downward cut 620, a major upward cut 622, a major downward cut 624, an intermediate upward cut 626, and a minor downward cut 628. As used herein, a "minor cut" has a length that is shorter than a length of a "major cut" such that a "major cut" extends farther into lower rear panel 516 and upper rear panel 518 than the "minor cuts" do. Further, an "intermediate cut" has a slope that is less than a slope of the other cuts in series 612 such that the "intermediate cuts" have a length that is longer than the lengths of the "minor cuts" and the "major cuts" without extending as far into lower rear panel 516 and upper rear panel 518 as the "major cuts" do. Each cut 618, 620, 622, 624, 626, and 628 is not orthogonal to fold line 530 and extends, at least partially, below fold line 530 into lower rear panel 516 and, at least partially, above fold line 530 into upper rear panel 518. Major upward cut 622 and major downward cut 624 extend into upper rear panel 518 to define an apex 630 at a mid-point of series 612. As such, major upward cut 622 and major downward cut 624 form an inverted major "V" in a center of series 612. Minor inverter "V"s are defined at an intersection of minor upward cut 618 and intermediate downward cut 620 and between intermediate upward cut 632 and minor downward cut 628. In the exemplary embodiment, cuts 618, 620, 622, 624, 626, and 628 are continuous with adjacent cuts 618, 620, 622, 624, 626, and/or 628 to form a continuous cut line 632.

Upper cut line 614 includes a first end 634, a second end 636, and a mid-point 638 approximately half way between first end 634 and second end 636. Upper cut line 614 is V-shaped and includes two substantially straight cuts that form continuous cut line 614. More specifically, upper cut line 614 includes a downward cut 640 extending between first end 634 and mid-point 638 and an upward cut 642 extending between mid-point 638 and second end 636 such that an apex is defined at mid-point 638. As such, mid-point 638 is nearer series 612 than ends 634 and 636 are. Further, the apex mid-point 638 points to apex 630, and apex mid-point 638 and apex 630 are substantially positioned on axis 616. At alternative embodiment of anti-buckling mechanism 610 is shown in FIGS. 14-17.

FIG. 11 is a back view of an exemplary anti-buckle container 700 formed from blank 500 (shown in FIG. 10) in the closed configuration. FIG. 12 is a perspective view of container 700 in the open configuration. FIG. 13 is a perspective view of an exterior of container 700 in the open configuration. Container 700 includes a bottom tray 702 and a top cover 704 connected to each other at fold line 530 and/or anti-buckling mechanism 610. Tray 702 includes a lower front wall 706, a first lower side wall 708, a lower rear wall 710, a second lower side wall 712, and a bottom wall 714. Locking flap 510 extends into or above a cavity 716 of tray 702. Cover 704 includes an upper front wall 718, a first upper side wall 720, an upper rear wall 722, a second upper side wall 724, and a top wall 726. In the closed configuration, lower front wall 706 and upper front wall 718 form a front wall (not shown), first lower side wall 708 and first upper side wall 720 form a first side wall 728, lower rear wall 710 and upper rear wall 722 form a rear wall 730, and second lower side wall 712 and second upper side wall 724 form a second side wall 732.

In the exemplary embodiment, first lower side wall 708 includes first lower front coupling tab 542 (shown in FIG. 10) and first lower rear coupling tab 550 coupled to first lower side panel 558. Similarly, second lower side wall 712 includes second lower front coupling tab 546 (shown in FIG. 10) and second lower rear coupling tab 554 coupled to second lower side panel 562. First upper side wall 720 includes first upper front coupling tab 574 (shown in FIG. 10) and first upper rear coupling tab 582 coupled to first upper side panel 590, and second upper side wall 724 includes second upper front coupling tab 578 (shown in FIG. 10) and second upper rear coupling tab 586 coupled to second upper side panel 594.

In the closed configuration and in the open configuration, an opening 734 is defined at series 612. Further, an upper opening 736 may be defined at upper cut line 614. Opening 734 and/or upper opening 736 enable container 700 to be transitioned between the closed configuration and the open configuration without buckling at lower rear wall 710, upper rear wall 722, and/or fold line 530.

Figure 14:
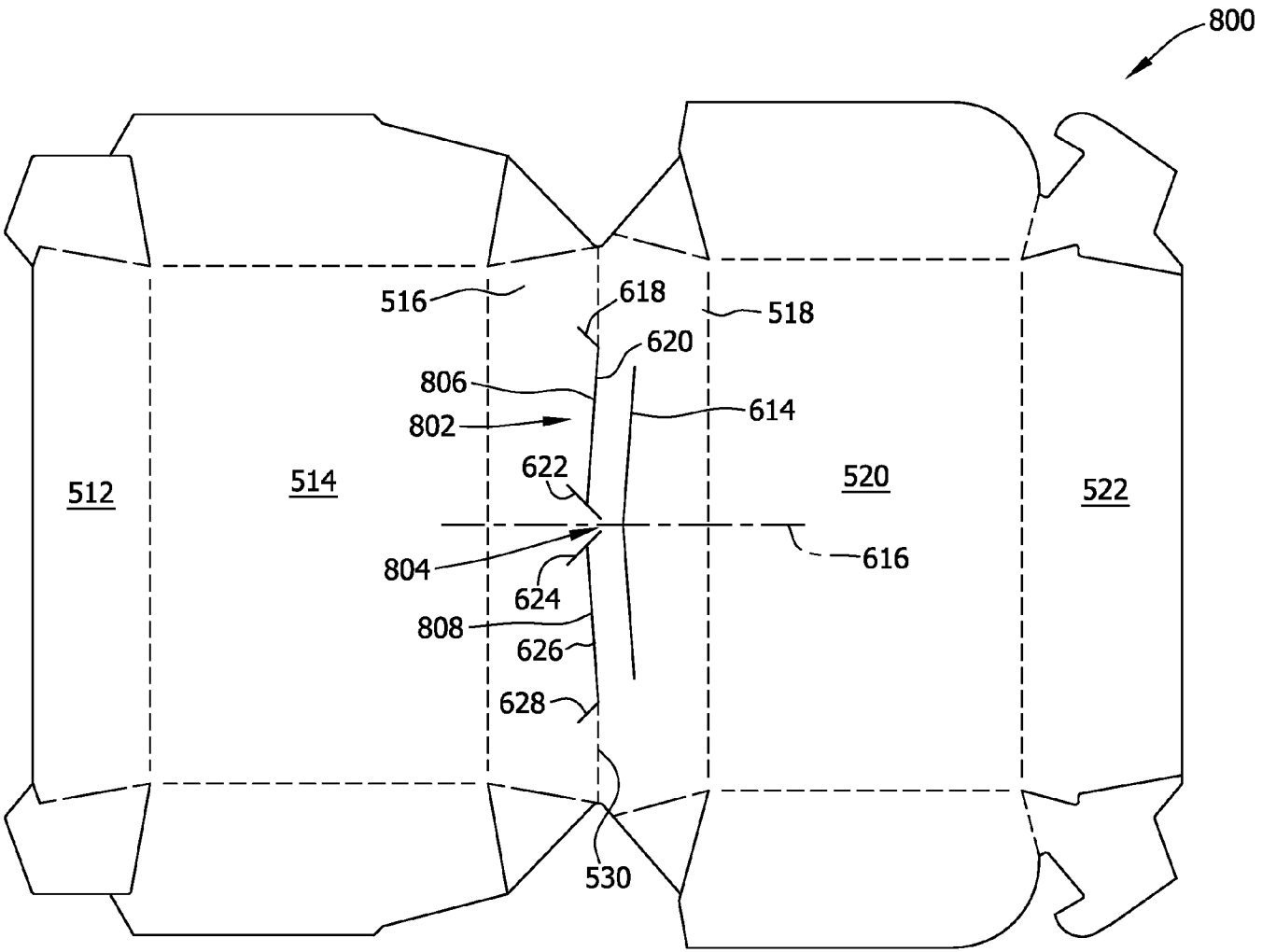
Figure 15:
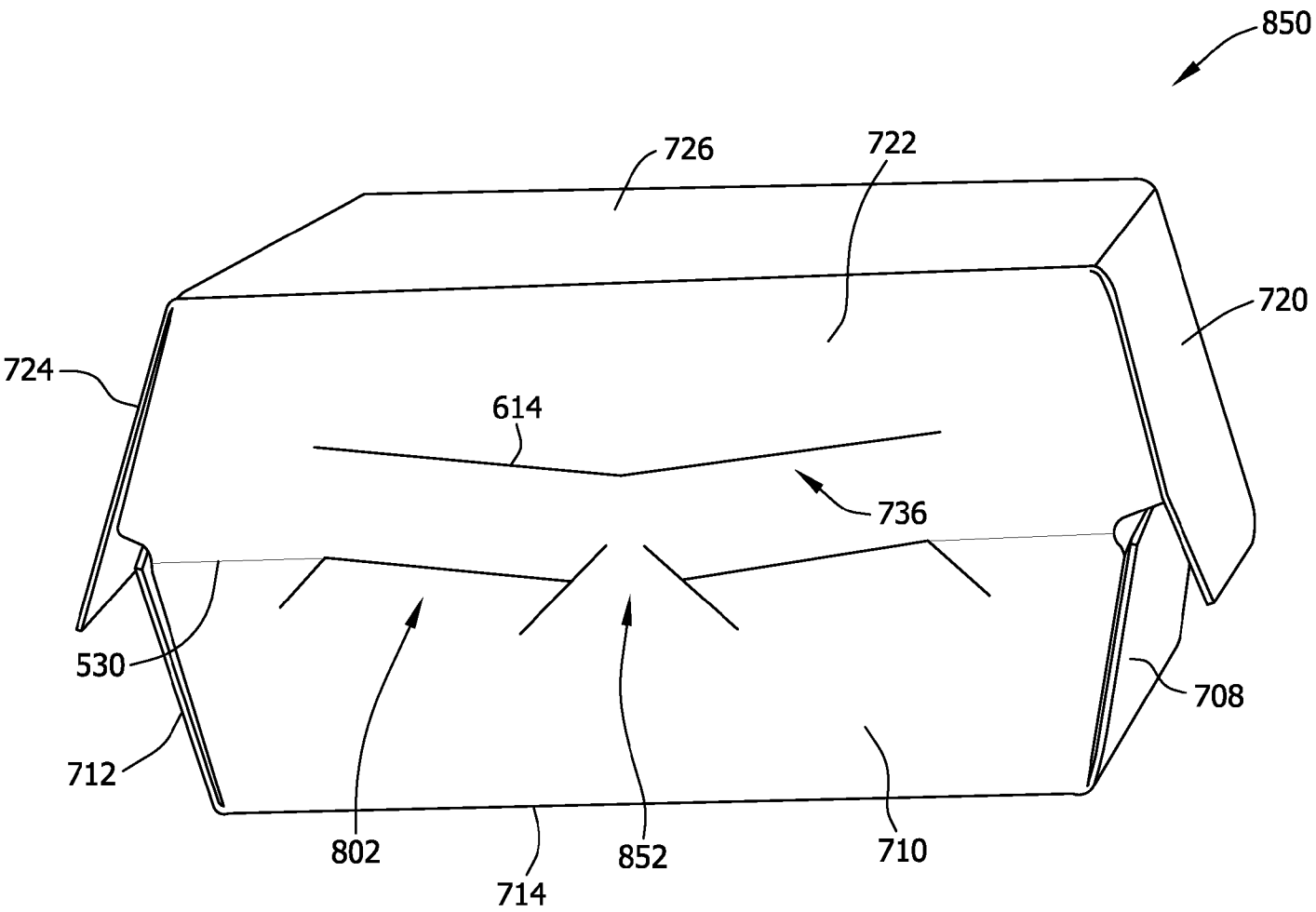
Figure 16:
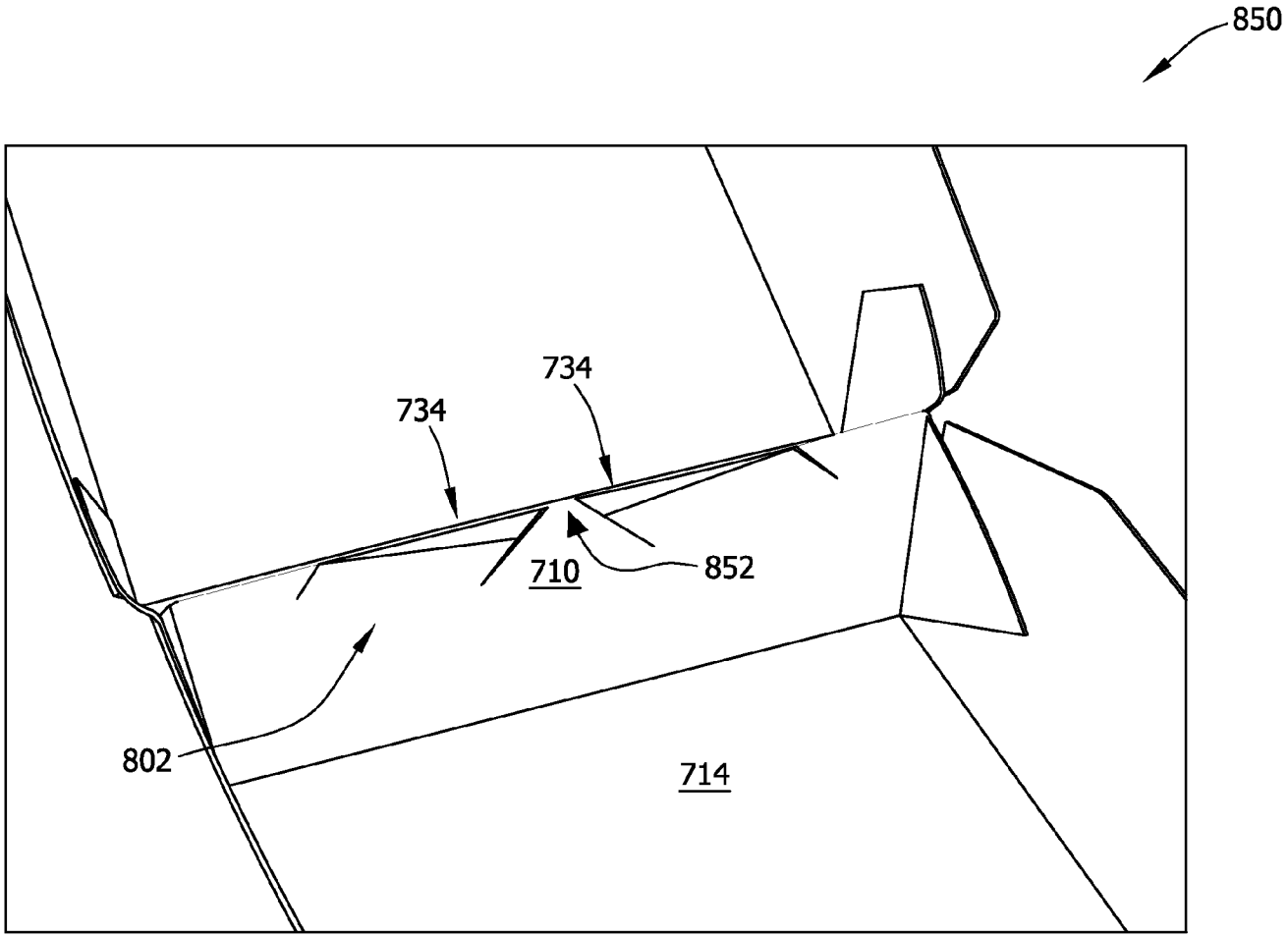
Figure 17:
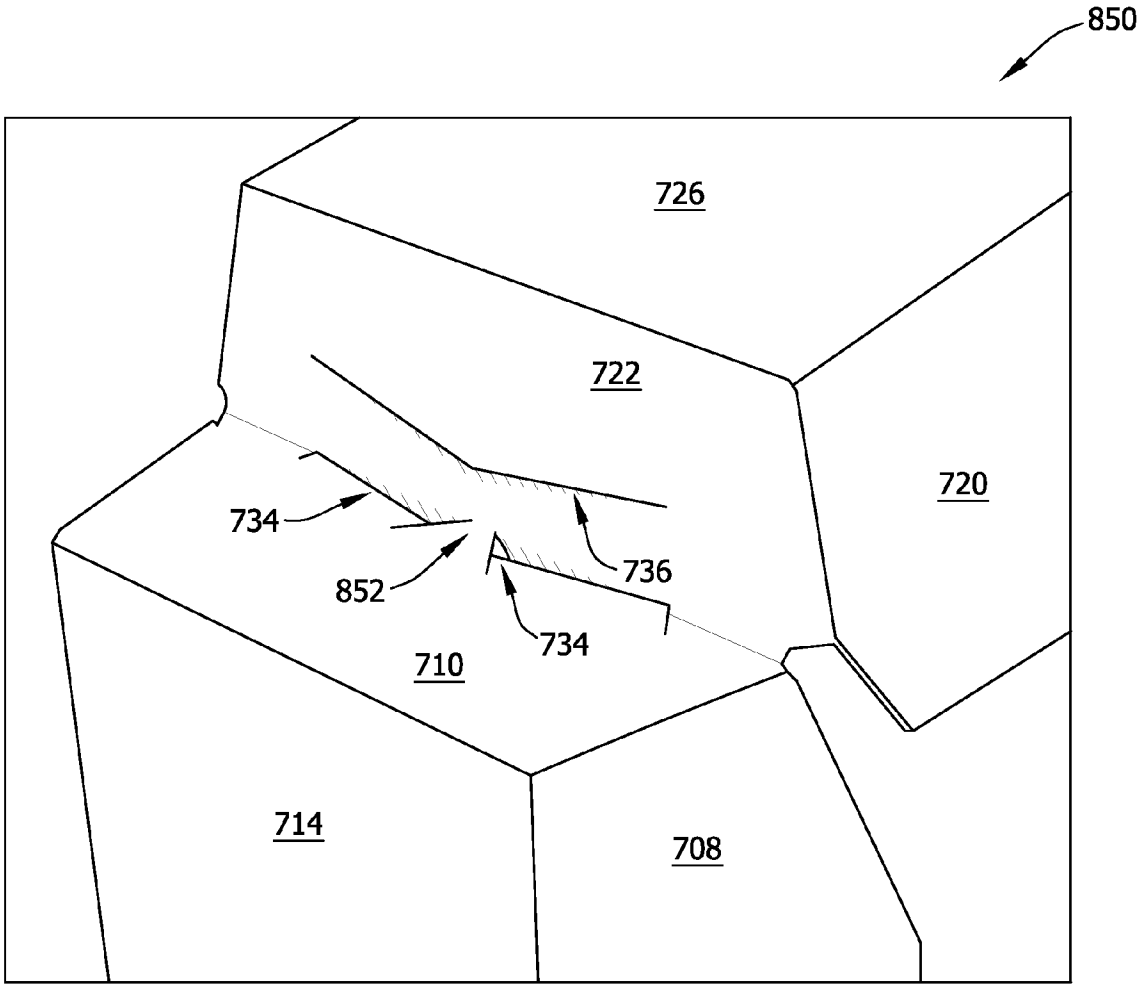

FIG. 14 is a top view of an interior surface of a fourth alternative blank 800 of sheet material for forming a fourth alternative anti-buckle container. FIG. 15 is a back view of an exemplary anti-buckle container 850 formed from blank 800 (shown in FIG. 14) in the closed configuration. FIG. 16 is a perspective view of an interior of container 850 in an open configuration. FIG. 17 is a perspective view of an exterior of container 850 in the open configuration. Blank 800 is substantially similar to blank 500 (shown in FIG. 10), except blank 800 includes a series 802 having a gap 804 and a hook-and-projection locking mechanism, as described in more detail with respect to FIG. 1. As such, components shown in FIGS. 14-17 are labeled with the same reference numbers used in FIGS. 1 and 10-13.

In the exemplary embodiment, gap 804 is defined between major upward cut 622 and major downward cut 624 such that a portion of material extends between ends of cuts 622 and 624. As such, series 802 includes two continuous cut lines separated by gap 804. More specifically, minor upward cut 618, intermediate downward cut 620, and major upward cut 622 define a first continuous cut line 806; and major downward cut 624, intermediate upward cut 626, and minor downward cut 628 defined a second continuous cut line 808. Upper rear panel 518 is connected to lower rear panel 516 at gap 804, which is intersected by axis 616.

The portion of material within gap 804 forms a wedge-shaped portion 852 connecting lower rear wall 710 and upper rear wall 722. Openings 734 are defined on both sides of portion 852 by cut lines 806 and 808 when container 850 is in the open configuration.

The anti-buckling mechanism described herein includes substantially straight lines that are simpler to form than curved lines, such as U-shaped or J-shaped lines. Further, the anti-buckling mechanism extends more than half the length of the fold line connecting the rear panels to provide better anti-buckling functionality than anti-buckling features that extend up to half of the length of the fold line. Moreover, at least some embodiments of the anti-buckling mechanism described herein include a series of cut lines separated by portions of material such that the panels remain connected to each other. The portions of material facilitate prevent the rear panels from separating.

Exemplary embodiments of a blank and a container having an anti-buckling mechanism are described above in detail. The blanks and containers are not limited to the specific embodiments described herein, but rather, components of blanks and/or containers may be utilized independently and separately from other components described herein. For example, the anti-buckling mechanism may also be used in combination with other types of blanks and containers, and are not limited to practice with only the clamshell containers as described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank of sheet material for forming a container, the blank comprising:

a tray panel assembly;

a cover panel assembly;

a fold line connecting the tray panel assembly and the cover panel assembly; and an anti-buckling mechanism interrupting the fold line and comprising:

a series of cuts defining at least one cut line, the series of cuts positioned at least partially below the fold line in the tray panel assembly, the series of cuts extending more than half a length of the fold line, each individual cut of the series of cuts being substantially straight, the series of cuts comprising a first cut and a second cut adjacent to the first cut, the first and second cuts oriented obliquely relative to the fold line such that the first and second cuts converge towards one another as the first and second cuts extend away from the fold line and into the cover panel assembly; and an upper cut line defined in the cover panel assembly.

2. A blank in accordance with claim 1, wherein the series of cuts further defines at least a first cut line and a second cut line adjacent to the first cut line, and wherein the first cut line includes the first cut and the second cut line includes the second cut.

3. A blank in accordance with claim 2, wherein the first cut line is separated by a gap from the second cut line, wherein the gap defines a finger of sheet material separating the first cut line and the second cut line.

4. A blank in accordance with claim 3, wherein the tray panel assembly comprises a lower rear panel and the cover panel assembly comprises an upper rear panel, the finger couples the lower rear panel to a strap defined in the upper rear panel, the finger configured to push the strap upward from a remaining portion of the upper rear panel to prevent buckling of the container at the upper rear panel and the lower rear panel.

5. A blank in accordance with claim 2, wherein each of the first and second cut lines comprises a downward cut, a substantially horizontal cut, and an upward cut.

6. A blank in accordance with claim 2, wherein each of the first and second cut lines comprises a minor cut, an intermediate cut, and a major cut.

7. A blank in accordance with claim 1, wherein the at least one cut line comprises, in series, a first minor cut, a first intermediate cut, a first major cut, a second major cut, a second intermediate cut, and a second minor cut.

8. A blank in accordance with claim 1, wherein the upper cut line comprises one of an arcuate cut line, a substantially straight cut line, and a V-shaped cut line.

9. A blank in accordance with claim 1, wherein the upper cut line has a length that is shorter than a length of the series of cuts.

10. A blank in accordance with claim 1, wherein each cut of the series of cuts connects to at least one other cut of the series of cuts such that the series of cuts defines at least one continuous cut line.

11. A container formed from a blank of sheet material, the blank comprising:

a lower tray;

an upper cover;

a fold line connecting the lower tray and the upper cover; and an anti-buckling mechanism interrupting the fold line and comprising:

a series of cuts defining at least one cut line, the series of cuts positioned at least partially below the fold line in the lower tray, the series of cuts extending more than half a length of the fold line, each individual cut of the series of cuts being substantially straight, the series of cuts comprising a first cut and a second cut adjacent to the first cut, the first and second cuts oriented obliquely relative to the fold line such that the first and second cuts converge towards one another as the first and second cuts extend away from the fold line and into the upper cover; and an upper cut line defined in the upper cover.

12. A container in accordance with claim 11, wherein the series of cuts further defines at least a first cut line and a second cut line adjacent to the first cut line, and wherein the first cut line includes the first cut and the second cut line includes the second cut.

13. A container in accordance with claim 12, wherein the first cut line is separated by a gap from the second cut line, wherein the gap defines a finger of sheet material separating the first cut line and the second cut line and connecting the lower tray and the upper cover.

14. A container in accordance with claim 13, wherein a strap is defined in an upper rear wall of the upper cover, the finger configured to push the strap upward from a remaining portion of the upper rear wall to prevent buckling of the container at the upper rear wall and a lower rear wall of the lower tray.

15. A container in accordance with claim 12, wherein each of the first and second cut lines comprises a downward cut, a substantially horizontal cut, and an upward cut.

16. A container in accordance with claim 15, wherein the upper cut line comprises one of an arcuate cut line and a substantially straight cut line.

17. A container in accordance with claim 12, wherein each of the first and second cut lines comprises a minor cut, an intermediate cut, and a major cut.

18. A container in accordance with claim 11, wherein the at least one cut line comprises, in series, a first minor cut, a first intermediate cut, a first major cut, a second major cut, a second intermediate cut, and a second minor cut.

19. A container in accordance with claim 11, wherein the upper cut line comprises a V-shaped cut line.

20. A blank of sheet material for forming a container, the blank comprising:

a tray panel assembly;

a cover panel assembly;

a fold line connecting the tray panel assembly and the cover panel assembly; and an anti-buckling mechanism interrupting the fold line and comprising:

a series of cuts defining at least one cut line, the series of cuts positioned at least partially below the fold line in the tray panel assembly, the series of cuts extending more than half a length of the fold line, each individual cut of the series of cuts being substantially straight, the at least one cut line comprising, in series, a first minor cut, a first intermediate cut, a first major cut, a second major cut, a second intermediate cut, and a second minor cut; and an upper cut line defined in the cover panel assembly.

* * * * *